US006935437B2

(12) United States Patent
Izumisawa

(10) Patent No.: US 6,935,437 B2
(45) Date of Patent: Aug. 30, 2005

(54) AIR DRILL

(75) Inventor: Nobuyuki Izumisawa, Itabashi-ku (JP)

(73) Assignee: Kabushiki Kaisha Shinano Seisakusho, Tokyo (JP)

( * ) Notice: Subject to any disclaimer, the term of this patent is extended or adjusted under 35 U.S.C. 154(b) by 146 days.

(21) Appl. No.: 10/655,897

(22) Filed: Sep. 4, 2003

(65) Prior Publication Data

US 2004/0060718 A1 Apr. 1, 2004

(30) Foreign Application Priority Data

Sep. 12, 2002 (JP) ..... 2002-266658

(51) Int. Cl.[7] ..... B25D 19/00

(52) U.S. Cl. ..... 173/93; 173/169; 173/218; 173/221

(58) Field of Search ..... 173/218, 221, 173/93, 93.5, 93.6, 104, 47, 169

(56) References Cited

U.S. PATENT DOCUMENTS 3,908,766 A * 9/1975 Hess ..... 173/178
5,112,338 A * 5/1992 Anspach, III ..... 606/99
5,213,136 A * 5/1993 Thorp et al. ..... 137/625.68
5,591,070 A * 1/1997 Kachich ..... 451/295
5,918,686 A * 7/1999 Izumisawa ..... 173/20
6,135,213 A * 10/2000 Schoeps ..... 173/93.5
6,634,438 B1 * 10/2003 Pusateri et al. ..... 173/1

* cited by examiner

*Primary Examiner*—Scott A. Smith
(74) *Attorney, Agent, or Firm*—Jordan and Hamburg LLP

(57) ABSTRACT

An air drill includes a body having a grip portion having an air supply passage and an air exhaust passage formed therein, a trigger portion formed above the grip portion and supporting a trigger, and a cylinder portion formed above the trigger portion and accommodating an air motor. A reverse valve is disposed within the cylinder portion in order to switch the direction of rotation of the air motor between forward and reverse directions. Two reverse levers are disposed in an upper portion of the reverse valve and slidably accommodated in two slit-shaped openings, respectively, which are formed in a grip-portion-side end of the cylinder portion.

3 Claims, 2 Drawing Sheets

AIR DRILL

BACKGROUND OF THE INVENTION

1. Field of the Invention

The present invention relates to an air drill, and more particularly to a portable air drill capable of changing its rotational direction.

2. Description of the Related Art

A body of a conventional portable air drill capable of changing its rotational direction comprises a grip portion which has an air supply passage and an air exhaust passage formed therein; a trigger portion which is formed above the grip portion and supports a trigger; and a cylinder portion which is formed above the trigger portion and accommodates an air motor therein.

A lock ring is threadingly engaged with an open end of the cylinder portion. A spindle is disposed inside the lock ring via bearings. A reverse valve is disposed within a closed end portion of the cylinder portion, opposite the open end thereof.

The reverse valve has a single reverse lever. Rotational direction of the air motor can be reversed through switching the reverse lever. The reverse lever is slidably attached to a slit-shaped opening formed at the closed end portion of the cylinder portion.

However, in the case where the conventional air drill is placed on a table or the like, if for some reason an air hose connected to the grip portion is pulled, the air drill may fall on the floor, and the body may be broken.

The above-described breakage occurs for the following reason. Since the air drill assumes a pistol-like shape, when the air house is pulled and the air drill falls on the floor, the air drill falls on the floor in such a posture that a crack is generated in a portion adjacent to the opening, where impact stresses concentrates, and the crack leads to breakage.

SUMMARY OF THE INVENTION

In view of the above-described problem of the conventional air drill, an object of the present invention is to provide an air drill which is hardly broken even when the drill falls on the floor, and which facilitates operation of a reverse lever.

In order to achieve the above object, the present invention provides an air drill comprising a body having a grip portion having an air supply passage and an air exhaust passage formed therein, a trigger portion formed above the grip portion, and a cylinder portion formed above the trigger portion; an air motor accommodated within the cylinder portion; a trigger disposed in the trigger portion and adapted to control supply of air from the air supply passage to the air motor; a reverse valve disposed within the cylinder portion and adapted to switch the direction of rotation of the air motor between forward and reverse directions; and two reverse levers disposed in an upper portion of the reverse valve and slidably accommodated in two slit-shaped openings, respectively, which are formed in a grip-portion-side end of the cylinder portion.

The above-described configuration enables a user to operate the reverse levers, during use of the air drill, by use of a single hand; i.e., only the hand with which the user holds the grip portion.

The body preferably has a bridge portion located between the two openings. In this case, the strength of the openings is increased, and thus, the air drill is hardly broken even when the air drill falls on the floor.

The openings are preferably symmetrically positioned with respect to a rotor shaft of the air motor. Since this configuration enables the dimensions of the openings as measured along the vertical direction to be freely increased or decreased, the design can be easily changed in order to change the position of attachment of the reverse levers to the reverse valve, increase the strength of the bridge portion, or change the positions of the revere levers in order to facilitate operation of the reverse levers.

DESCRIPTION OF THE PREFERRED EMBODIMENT

An embodiment of the present invention will be described with reference to the drawings.

Figure 1:
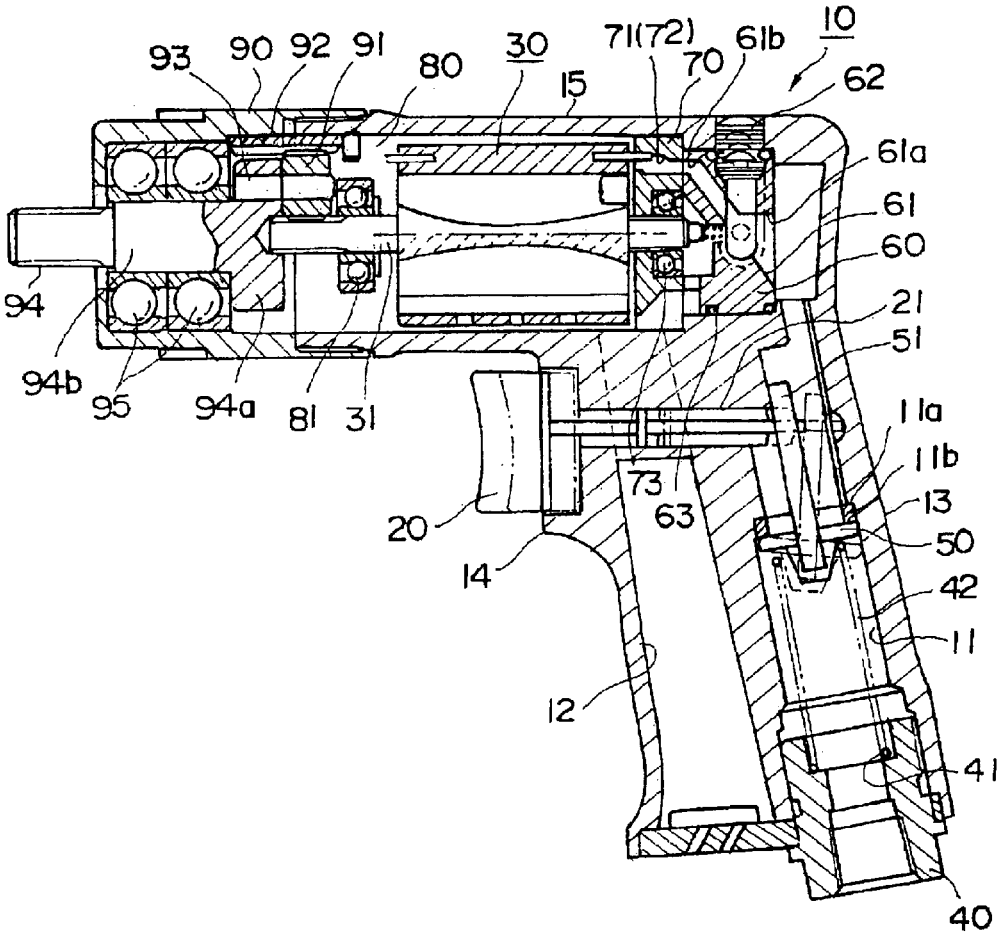
FIG. 1 is a longitudinal sectional view of an air drill according to an embodiment of the present invention.

In FIG. 1, reference numeral 10 denotes a body of an air drill. The body 10 includes a grip portion 13 which has an air supply passage 11 and an air exhaust passage 12 formed therein; a trigger portion 14 which is formed above the grip portion 13 and supports a trigger 20; and a cylinder portion 15 which is formed above the trigger portion 14 and accommodates an air motor 30 therein.

A bushing 40 is fitted into the lower end of the air supply passage 11. A step 11*a* is formed at a middle portion of the air supply passage 11. A valve 50 seats on the step 11*a* via a valve seat 11*b*.

A valve spring 42 is disposed between the valve 50 and a receiving portion 41 which is formed in an upper portion of the bushing 40. Thus, the valve 50 is pushed against the valve seat 11*b* by means of the valve spring 42.

A pin 51 is affixed to the valve 50, and is connected to a connecting rod 21 of the trigger 20. Thus, when the trigger 20 is pushed, the connecting rod 21 is moved rightward in FIG. 1, whereby the pin 51 is tilted, and the valve 50 is opened to supply air to the air motor 30.

When the trigger 20 is not pushed, the valve spring 42 presses the valve 50 against the valve seat 11*b*, so that the valve 50 is closed, and the pin 51, the connecting rod 21, and the trigger 20 are returned to their original positions.

The air supply passage 11 communicates with a reverse valve 60, which is disposed within a rear end portion of the cylinder portion 15, and is adapted to switch the direction of rotation of the air motor 30 between forward and reverse directions. The reverse valve 60 has an air passage 61 and two reverse levers 62, and is rotatably disposed within the cylinder portion 15 via an O-ring 63.

Figure 2:
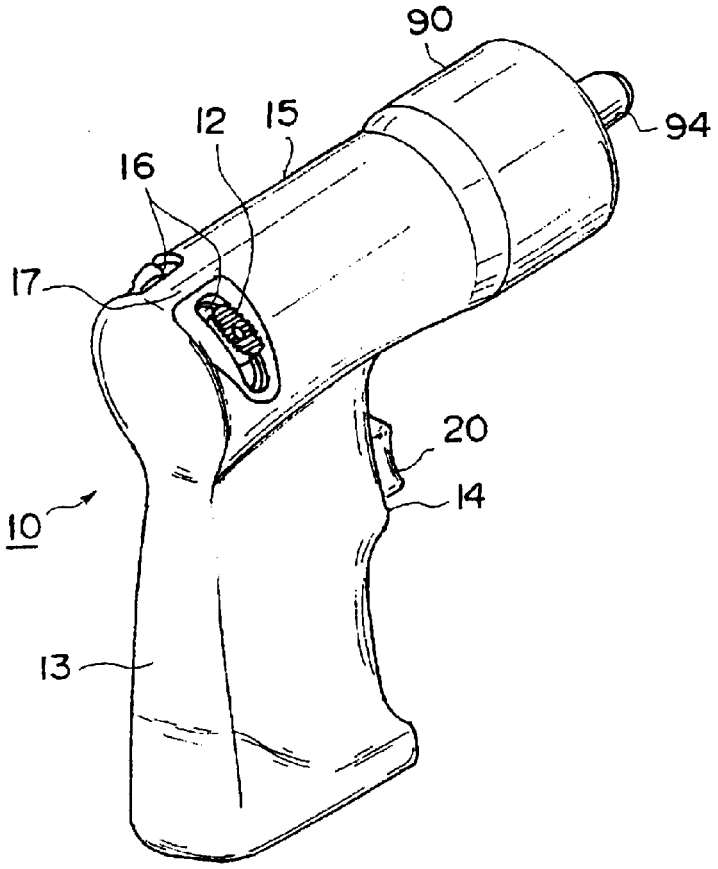
FIG. 2 is a perspective view of the air drill of FIG. 1.
Figure 3:
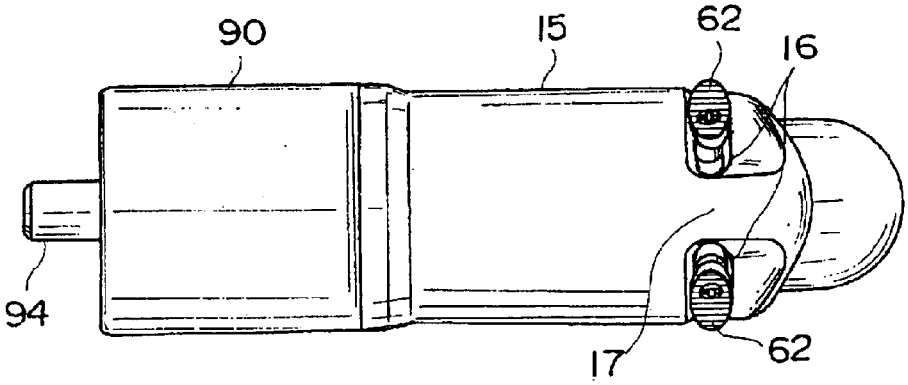
FIG. 3 is a plan view of the air drill of FIG. 1.

The two reverse levers 62 are disposed in an upper portion of the reverse valve 60, and, as shown FIGS. 2 and 3, are slidably accommodated in two slit-shaped openings 16, respectively, which are formed in the rear end portion (grip-portion-side end portion) of the cylinder portion 15. The body 10 has a bridge portion 17, which is located between the two openings 16 and extends in parallel to a rotor shaft 31 (see FIG. 1) of the air motor 30. The two openings 16 are symmetrically positioned with respect to the rotor shaft 31 of the air motor 30.

The air passage 61 has a wide air inlet 61*a* and a narrow air outlet 61*b*. The reverse valve 60, which is in contact with a back plate 70 of the air motor 30, is rotated, while being slid on the back plate 70. The reverse valve 60 has an air hole 71 for rotation in the forward direction, and an air hole 72 for rotation in the reverse direction. When the air hole 71 is connected to the air outlet 61*b* upon rotation of the reverse valve 60, the air motor 30 rotates in the forward direction. When the air hole 72 is connected to the air outlet 61*b* upon rotation of the reverse valve 60, the air motor 30 rotates in the reverse direction.

The rotor shaft 31 of the air motor 30 is rotatably supported by means of a bearing 73 fixed to the back plate 70 and a bearing 81 fixed to a front plate 80.

A cylindrical lock ring 90 is threadingly engaged with the open end of the cylinder portion 15. A speed reducer composed of an idle gear 91, an internal gear 92, and an idle pin 93; a spindle 94; and bearings 95 are accommodated in the lock ring 90.

The idle gear 91 is in meshing engagement with the rotor shaft 31, and is connected to a head portion 94*a* of the spindle 94 via the idle pin 93. The idle gear 91 is also in meshing engagement with the internal gear 92 fixed to the lock ring 90. Therefore, rotational power generated in the rotor shaft 31 is transmitted to the spindle 94 via the speed reducer. Notably, a shaft portion 94*b* of the spindle 94 is rotatably supported by means of the bearings 95 fixed to the lock ring 90.

The air drill having the above-described construction operates as follows. When the reverse valve 60 is rotated clockwise (as viewed from the rear of the air drill) upon sliding of the corresponding reverse lever 62, the air motor 30 rotates in the forward direction, whereby the spindle 94 rotates in the forward direction. By contrast, when the reverse valve 60 is rotated counterclockwise upon sliding of the corresponding reverse lever 62, the air motor 30 rotates in the reverse direction, whereby the spindle 94 rotates in the reverse direction.

What is claimed is:

1. An air drill comprising:

a body having a grip portion having an air supply passage and an air exhaust passage formed therein, a trigger portion formed above the grip portion, and a cylinder portion formed above the trigger portion;

an air motor accommodated within the cylinder portion;

a trigger disposed in the trigger portion and adapted to control supply of air from the air supply passage to the air motor;

a reverse valve disposed within the cylinder portion and adapted to switch the direction of rotation of the air motor between forward and reverse directions; and two reverse levers disposed in an upper portion of the reverse valve and slidably accommodated in two slit-shaped openings, respectively, which are formed in a grip-portion-side end of the cylinder portion.

2. An air drill according to claim 1, wherein the body has a bridge portion located between the two openings.

3. An air drill according to claim 1, wherein the openings are symmetrically positioned with respect to a rotor shaft of the air motor.

* * * * *